US009838770B2

(12) United States Patent
Aase

(10) Patent No.: US 9,838,770 B2
(45) **Date of Patent: *Dec. 5, 2017**

(54) SEAMLESS EARBUD STRUCTURES AND METHODS FOR MAKING THE SAME

(71) Applicant: Apple Inc., Cupertino, CA (US)

(72) Inventor: Jonathan S. Aase, Rochester, MI (US)

(73) Assignee: APPLE INC., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/006,046

(22) Filed: Jan. 25, 2016

(65) Prior Publication Data

US 2016/0142807 A1 May 19, 2016

Related U.S. Application Data

(63) Continuation of application No. 14/626,727, filed on Feb. 19, 2015, now abandoned, which is a continuation of application No. 13/251,002, filed on Sep. 30, 2011, now Pat. No. 8,965,030.

(60) Provisional application No. 61/453,074, filed on Mar. 15, 2011.

(51) Int. Cl.
*H04R 1/10* (2006.01)

(52) U.S. Cl.
CPC ..... *H04R 1/1016* (2013.01); *H04R 1/1058* (2013.01); *H04R 1/1075* (2013.01); *H04R 1/1066* (2013.01); *H04R 2201/105* (2013.01); *H04R 2460/09* (2013.01); *H04R 2460/11* (2013.01); *Y10T 29/49176* (2015.01)

(58) Field of Classification Search
CPC .. H04R 25/60; H04R 25/65; H04R 2225/023; H04R 2225/025; H04R 1/10; H04R 2205/022; H04R 1/105; H04R 5/0335; H04R 2201/10; H04R 2460/13; H04R 1/1016
USPC ..... 381/322, 328, 370, 374, 380–381
See application file for complete search history.

(56) References Cited

U.S. PATENT DOCUMENTS

| | | | |
|---|---|---|---|
| 2,125,348 | A | 8/1938 | Kunman |
| 2,477,046 | A | 7/1949 | Davenport |
| 2,493,734 | A | 6/1950 | Pearson |
| 2,882,348 | A | 4/1959 | Erickson |
| 3,209,080 | A | 9/1965 | Clemens et al. |
| 3,239,093 | A | 3/1966 | Tony |
| 3,906,170 | A | 9/1975 | Guice |
| 4,443,668 | A | 4/1984 | Warren |
| 4,791,673 | A | 12/1988 | Schreiber |
| 5,497,427 | A | 3/1996 | Nageno |

(Continued)

*Primary Examiner* — Suhan Ni
(74) *Attorney, Agent, or Firm* — Van Court & Aldridge LLP

(57) ABSTRACT

Seamless earbud structures and methods for making the same are disclosed. Seamless earbud structures can be constructed using an insert molding construction method, which overmolds a cosmetic material over two sub-enclosures that are mated together. The two sub-enclosures form a housing that can encompass a driver assembly (e.g., woofer and tweeter), a conductor bundle, and provide one or more acoustic volumes. The housing has a non-occluding member and a neck member, and has a seamless or nearly seamless construction. The cosmetic material is insert molded around the housing to provide a smooth and seamless surface disposed around the periphery of the housing.

20 Claims, 7 Drawing Sheets

(56) References Cited

U.S. PATENT DOCUMENTS

| | | | | |
|---|---|---|---|---|
| 6,058,198 | A * | 5/2000 | Aceti | H04R 5/04 381/322 |
| 6,081,604 | A | 6/2000 | Hikichi et al. | |
| 6,754,357 | B2 | 6/2004 | McIntosh et al. | |
| 7,616,772 | B2 | 11/2009 | Sabick et al. | |
| 2011/0002493 | A1* | 1/2011 | Campbell | H04R 25/65 381/330 |
| 2011/0019847 | A1 | 1/2011 | Klemenz et al. | |

* cited by examiner

SEAMLESS EARBUD STRUCTURES AND METHODS FOR MAKING THE SAME

This application is a continuation of U.S. application Ser. No. 14/626,727, filed Feb. 19, 2015, which is a continuation of U.S. application Ser. No. 13/251,002, filed Sep. 30, 2011 (now U.S. Pat. No. 8,965,030), which claims the benefit of U.S. Provisional Application No. 61/453,074, filed Mar. 15, 2011. Each of these earlier applications is incorporated by reference herein in its entirety.

BACKGROUND

Wired headsets are commonly used with many portable electronic devices such as portable music players and mobile phones. Headsets can include non-cable components such as a jack, headphones, and/or a microphone and one or more cables that interconnect the non-cable components. The headphones exist in many different form factors such as over-the-ear headphones or as in-the-ear or in-the-canal earbuds.

SUMMARY

Seamless earbud structures and methods for making the same are disclosed. Seamless earbud structures can be constructed using an insert molding construction method, which overmolds a cosmetic material over two sub-enclosures that are mated together. The two sub-enclosures form a housing that can encompass a driver assembly (e.g., woofer and tweeter), a conductor bundle, and provide one or more acoustic volumes. The housing has a non-occluding member and a neck member, and has a seamless or nearly seamless construction. The cosmetic material is insert molded around the housing to provide a smooth and seamless surface disposed around the periphery of the housing.

BRIEF DESCRIPTION OF THE DRAWINGS

The above and other aspects and advantages of the invention will become more apparent upon consideration of the following detailed description, taken in conjunction with accompanying drawings, in which like reference characters refer to like parts throughout, and in which.

DETAILED DESCRIPTION OF THE DISCLOSURE

Headphones or earbuds for use in headsets are disclosed. Earbuds according to embodiments of this invention include a non-occluding housing having a directional port offset with respect to a center axis of the earbud. The housing can have an asymmetric shape amenable to in-the-ear retention. In addition, the earbuds can be constructed to have a seamless finish even though two or more parts are joined together to form part of the earbud. As will be explained in more detail below, the earbuds can be constructed using an insert molding construction method, which overmolds a cosmetic material over two sub-enclosures that are mated together. Other construction methods for making earbuds include techniques for welding or bonding two halves of an earbud together, and then de-flashing and polishing the earbud to obtain the desired aesthetics.

Figure 1:
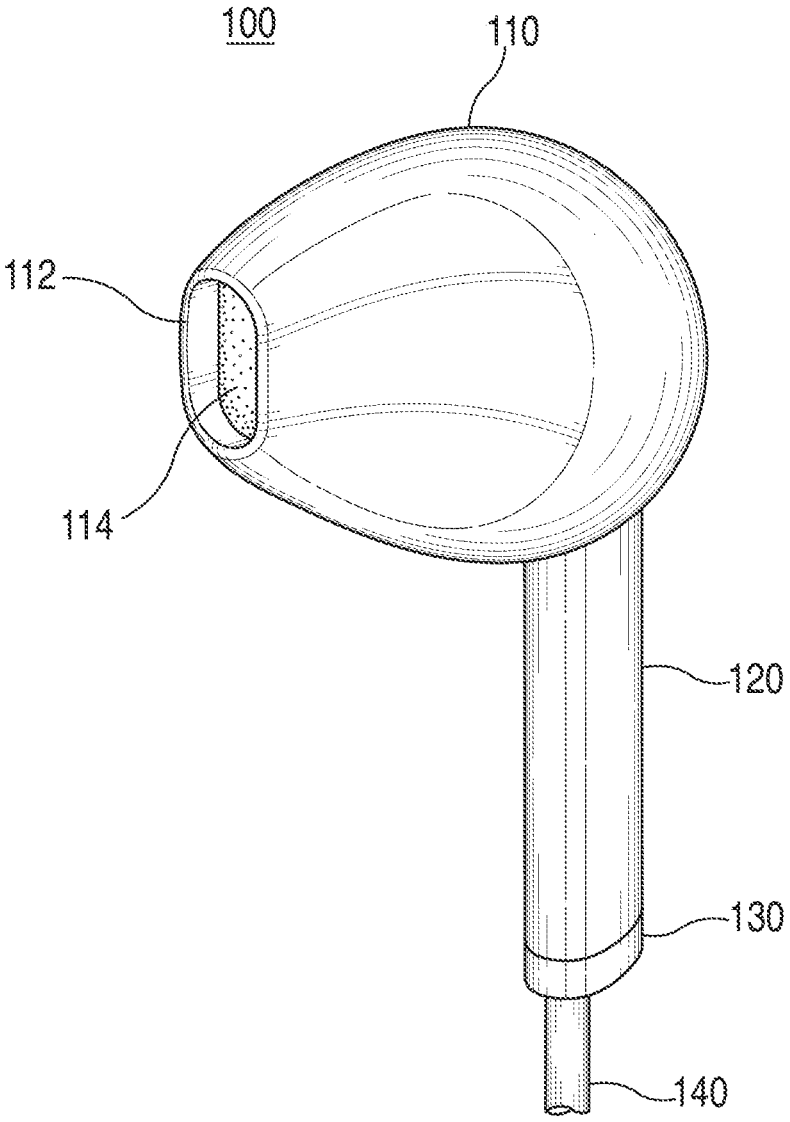
FIG. 1 shows an illustrative perspective view of an earbud in accordance with an embodiment of the invention.

FIG. 1 shows an illustrative perspective view of earbud 100 in accordance with an embodiment of the invention. As shown, earbud 100 can include non-occluding member 110, directional port 112, filter 114, neck member 120, strain relief member 130, and conductor bundle 140. Earbud 100 can also include a driver assembly (not shown) for generating sound. The driver assembly can include, for example, a woofer and a tweeter.

Non-occluding member 110 is designed to fit in the ear of a user in a non-occluding manner. Non-occluding earbuds are generally designed not to form an airtight seal between the ear and the outer surface of the earbud. However, depending on the size of the user's ear, there may be instances when the earbud does form an airtight seal with the user's ear. By way of contrast, occluding earbuds are generally designed to fit inside of the user's ear canal and form a substantially perfect airtight seal.

Figure 2A:
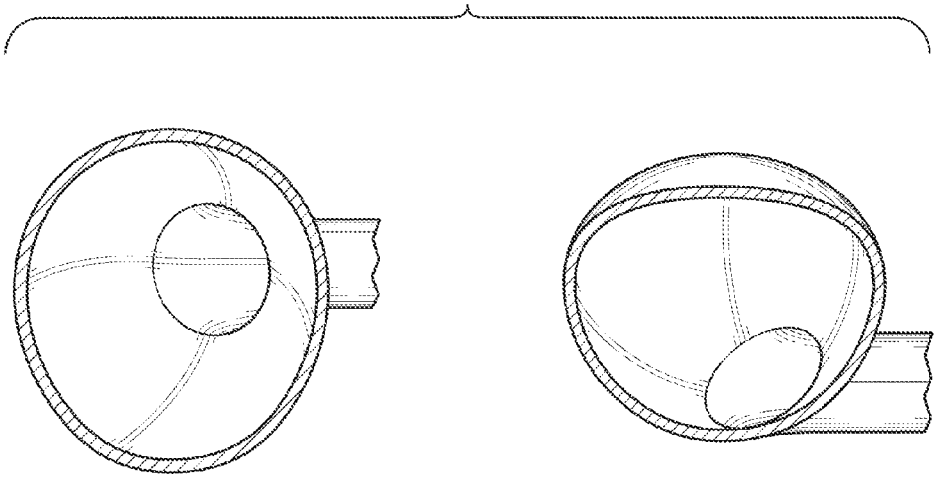
FIGS. 2-2C show illustrative cross-sectional views of the earbud of FIG. 1 in accordance with an embodiment of the invention.
Figure 2:
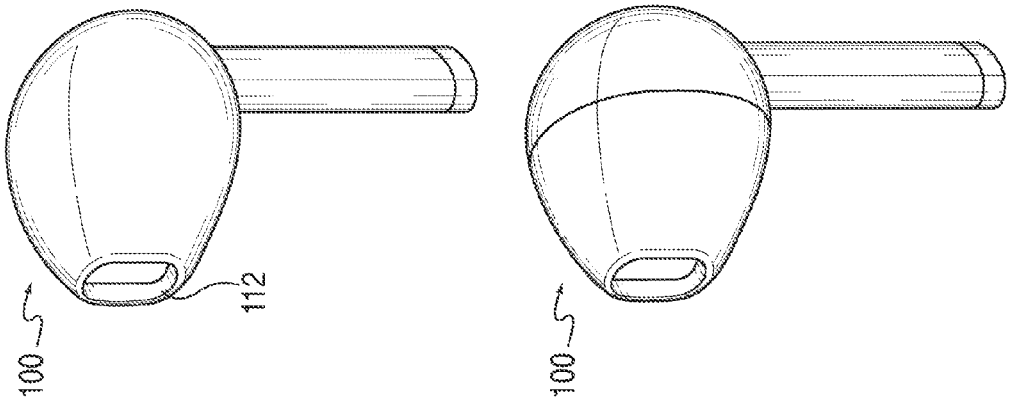
Figure 2C:
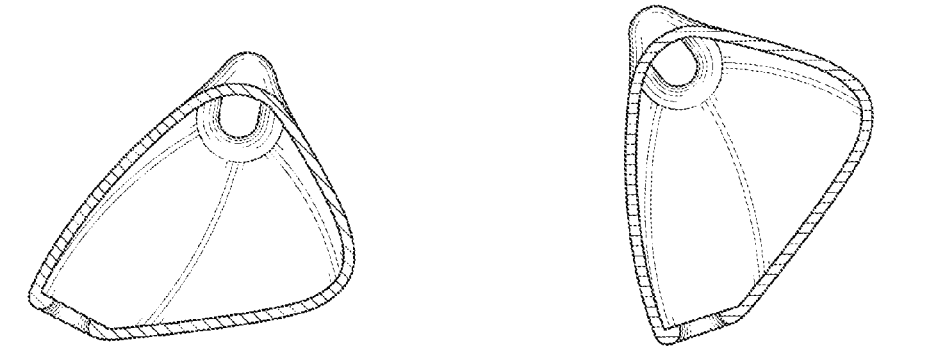
Figure 2B:
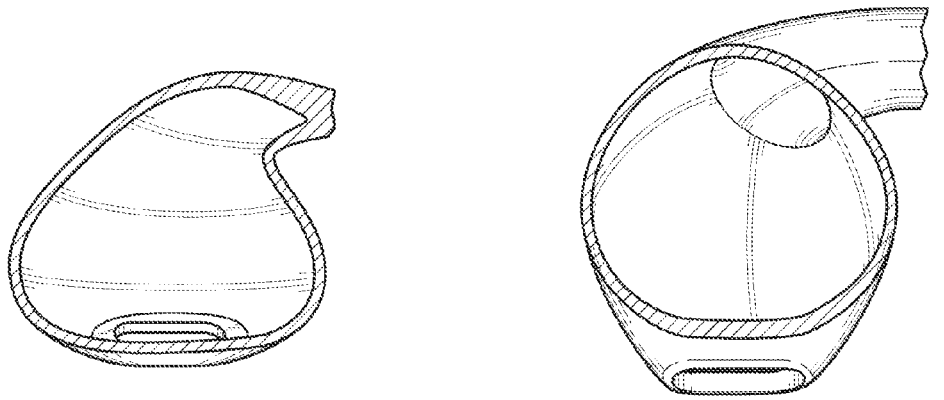

Referring now to FIG. 2, the shape of non-occluding member 110 is discussed. FIG. 2 shows two illustrative perspective views of earbud 100, one shown at zero degrees and the other shown rotated at forty-five degrees. FIGS. 2A-2C show illustrative cross-sectional views taken along planes A-A, B-B, and C-C, respectively, of the 0° perspective view and the 45° perspective view of earbud 100. Each of planes A, B, and C are orthogonal to each other and plane B coincides with a center axis of earbud 100. The cross-sectional views of FIGS. 2A-2C show that the shape of earbud 100 is irregular or asymmetric along each cross-section.

In addition, assuming plane B coincides with a center axis of earbud 100, directional port 112 is located offset with respect to the center axis. Directional port 112 is offset so that when earbud 100 is placed in a user's ear, directional port 112 is positioned to direct sound directly into the user's ear canal.

Figure 3:
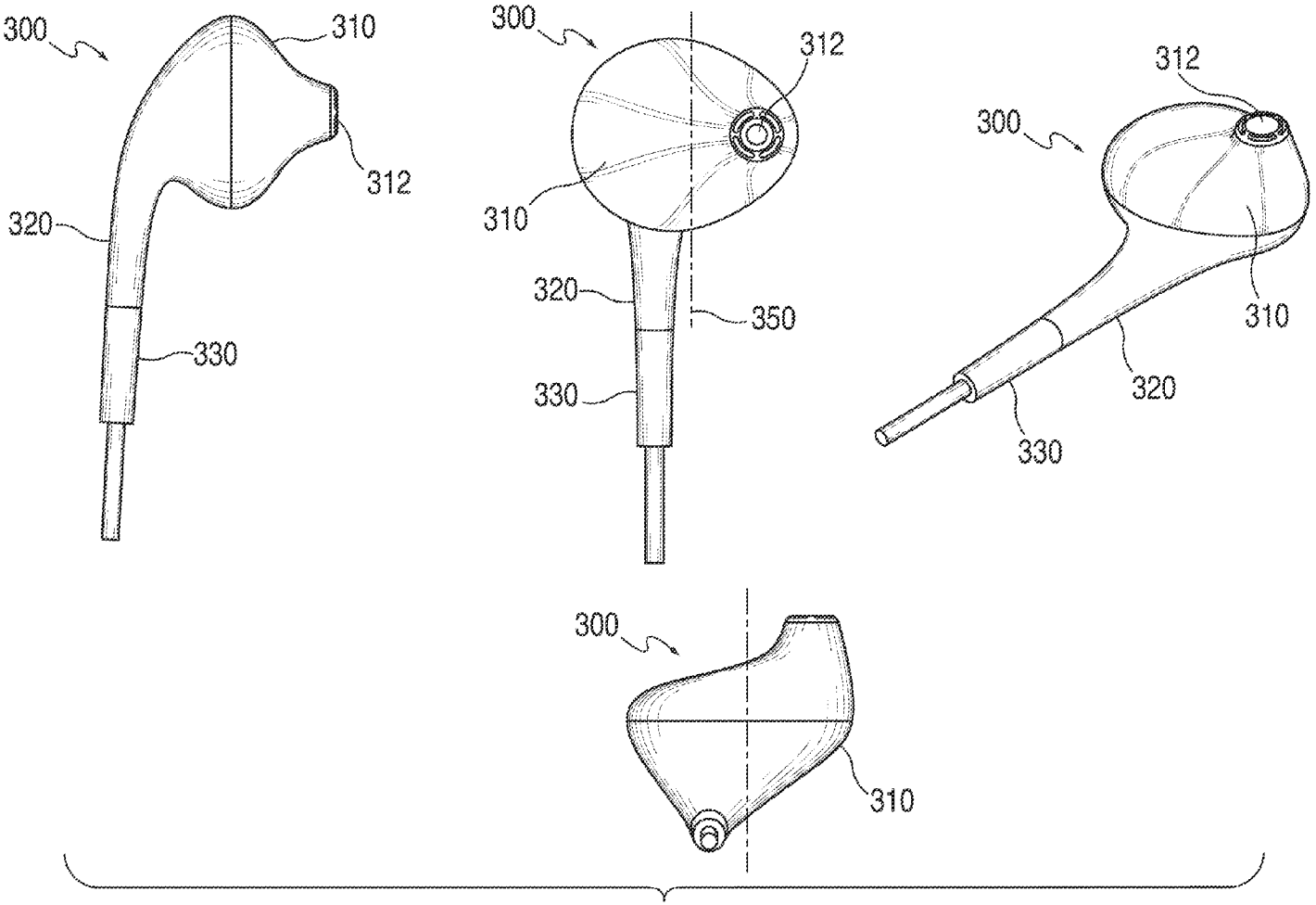
FIG. 3 shows several illustrative views of another earbud in accordance with an embodiment of the invention.

FIG. 3 shows several illustrative views of earbud 300 in accordance with an embodiment of the invention. In particular, FIG. 3 shows a side, front, top, and perspective views of earbud 300. As shown, earbud 300 is asymmetrically shaped along at least two orthogonal axes (e.g., at least two of orthogonal axes X, Y, and Z). In addition, directional port 312 is positioned offset with respect to center axis 350. Earbud 300 includes non-occluding member 310, directional port 312, neck member 320, and strain relief member 330.

The earbud embodiments shown in FIGS. 1-3 each show earbuds that exhibit desired cosmetic finishes. That is, the earbuds are seamless and appear to have a single piece construction even though they are constructed with multiple parts. Because earbuds according to the invention are irregularly shaped and have varying contours, it is difficult to mass produce such earbuds with the desired cosmetic finish. Referring now to FIGS. 4 and 5A-H, a process for manufacturing an earbud using an insert molding process according to an embodiment of the invention is discussed. In an insert molding process, a housing (which includes the non-occluding member, neck member, and any components contained therein (e.g., driver assembly)) is overmolded with a cosmetic material. The housing provides the desired shape such as the earbud shape shown in FIGS. 1-3 and the overmold material provides the seamless cosmetic finish.

Figure 4:
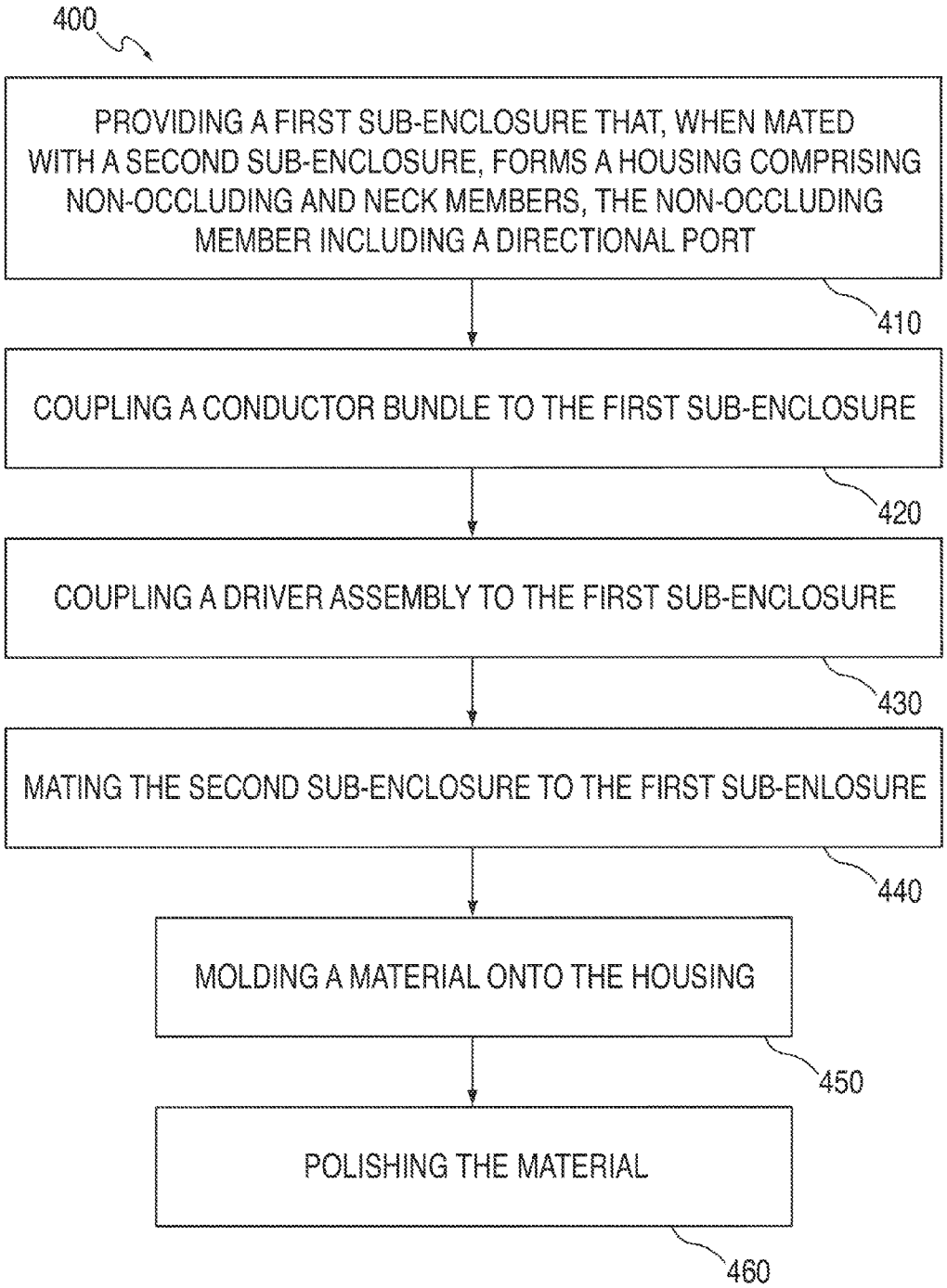
FIG. 4 shows an illustrative insert molding process for making an earbud in accordance with embodiments of the invention.
Figure 5A:
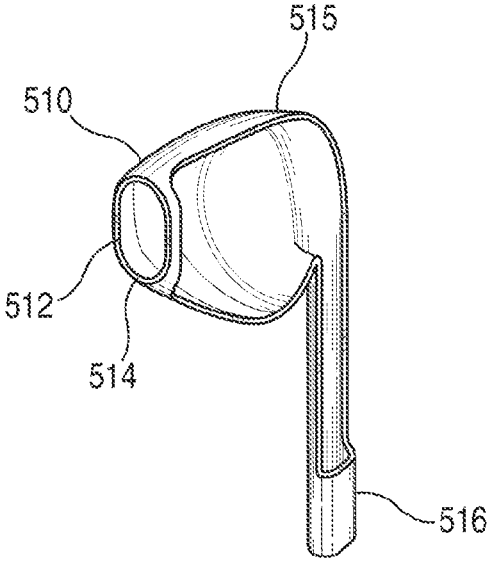
FIGS. 5A-H show different illustrative views of an insert molded earbud at different stages of the process of FIG. 4 in accordance with an embodiment of the invention.
Figure 5B:
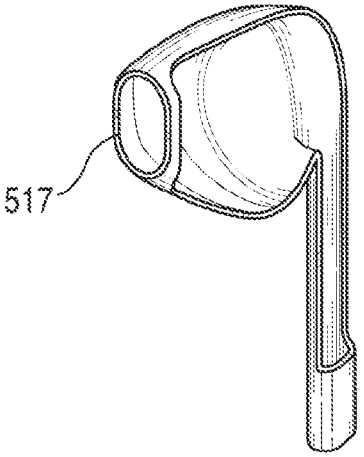
Figure 5C:
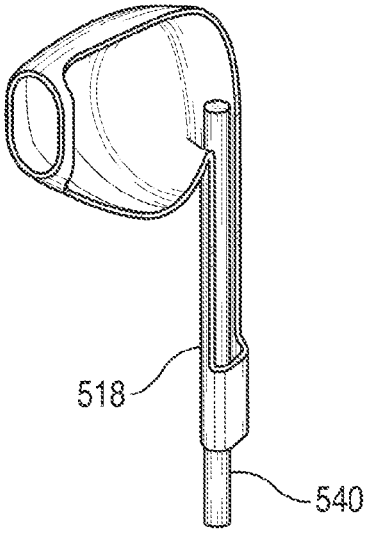
Figure 5D:
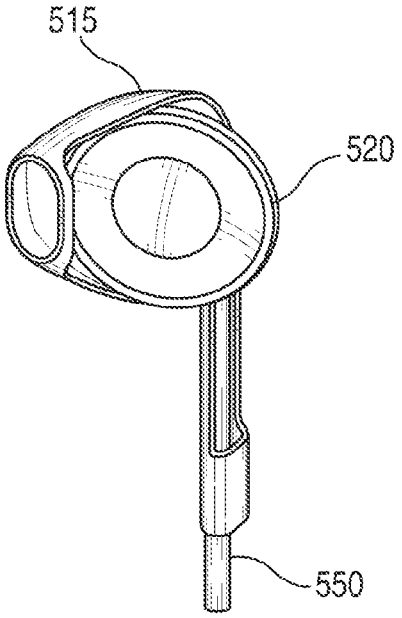

FIG. 4 shows an illustrative insert molding process 400 for making an earbud according to an embodiment of the invention. FIGS. 5A-H show different illustrative views of an earbud at different stages of process 400. Reference will be made to FIGS. 4 and FIGS. 5A-H during discussion of process 400. Beginning with step 410, a first sub-enclosure is provided that, when mated with a second sub-enclosure, forms a housing including non-occluding and neck members. FIG. 5A shows first sub-enclosure 510.

Figure 5E:
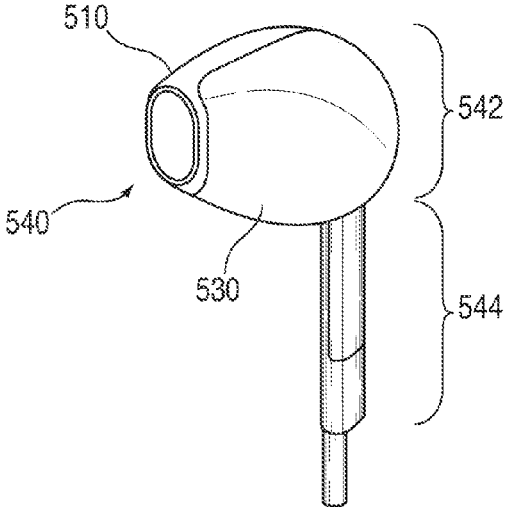

First sub-enclosure 510 can be constructed using any suitable material such as metal or plastic and is configured to mate with second sub-enclosure 530 (shown in FIG. 5E). Second sub-enclosure 530 can also be constructed using any suitable material such as metal or plastic. When enclosures 510 and 530 are mated, they form a housing 540 having non-occluding member 542 and neck member 544. Housing 540 can contain driver assembly 520 (FIG. 5D), a portion of conductor bundle 550 (FIGS. 5C and 5D), and other components (not shown).

First sub-enclosure 510 can include directional port 512, filter engagement region 514, driver assembly engagement region 515, dampener 516, other internal structures (not shown). Filter engagement region 514 is operative to receive filter assembly 517 (shown in FIG. 5B). Driver assembly engagement region 515 can be a structure that holds driver assembly 520 in place during assembly of the earbud. For example, region 515 can be a groove or slot into which drive assembly 520 can be inserted. Dampener 516 is optional but may be included to dampen low frequency vibrations that can be caused by conductor bundle movement.

Although not shown in FIGS. 5A-H, second sub-enclosure 530 can include internal features such as a driver assembly engagement region or one or more acoustic volume members. Sub-enclosure 510 can also include one or more acoustic volume members (not shown). The acoustic volume members can define the front and back volumes of the earbud. The front volume can be the portion of the earbud existing between driver assembly 520 and port 512 and the back volume can be the portion of the earbud existing behind driver assembly 520. If desired, a port may exist in the back volume.

At step 420, a conductor bundle is coupled to the first sub-enclosure. Conductor bundle 550 can include any suitable number of conductors for enabling conduction of signals and/or power. Conductor bundle 550 can also include one or more anti-tangle rods such as nitinol that resist plastic deformation. All or a portion of conductor bundle 550 can be coupled to sub-enclosure 510. In addition, a portion of conductor bundle 550 is coupled to driver assembly 520. In some embodiments, conductor bundle 550 can be slid through a conductor bundle engagement member 518 of dampener 516.

At step 430, a driver assembly is coupled to the first sub-enclosure. For example, driver assembly 520 can be inserted into driver retention member 515, which holds driver assembly 520 in place during assembly. Driver assembly 520 can be welded (e.g., laser welded) or glued to sub-enclosure 510. If desired, additional structures (e.g., acoustic volume member) or circuitry can be mounted within sub-enclosure 510 before step 440.

At step 440, the second sub-enclosure is mated to the first sub-enclosure. The first and second sub-enclosures may be secured using an adhesive, weld, or chemical bond. In some embodiments, a hermetic seal may exist between the first and second sub-enclosures. When sub-enclosures 510 and 530 are mated together, they provide housing 540, which includes non-occluding member 542 and neck member 544. An advantage of constructing an earbud with first and second sub-enclosures 510 and 530 is that the flushness of the mating fit can be tightly controlled. For example, the fit between sub-enclosures 510 and 530 can be such that any deviation between the two enclosures at any point along the junction is less than 0.04 mm, or more particularly, less than 0.02 mm. Such a tight tolerance fit enables a uniform coating of material to be molded onto the housing (step 450) and polished (step 460) to provide a smooth and seamless earbud.

Figure 5F:
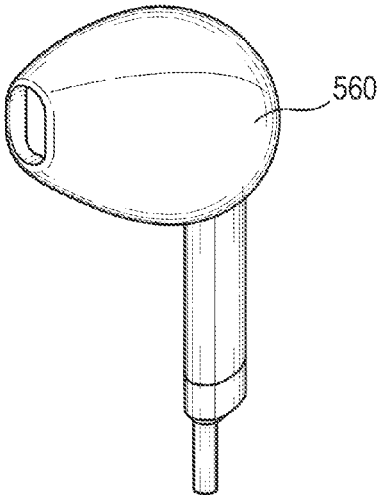

Material 560 may be injection molded around housing 540, as shown in FIG. 5F. In an injection mold, one or more shutoffs are used to limit flow of injected plastic. A shutoff can be placed near the end of port 512 and another can be placed near the base of neck member 544. The material may be fed near the base of neck member 544 to minimize any potential for cosmetic blemishes of non-occluding member 542.

Figure 5G:
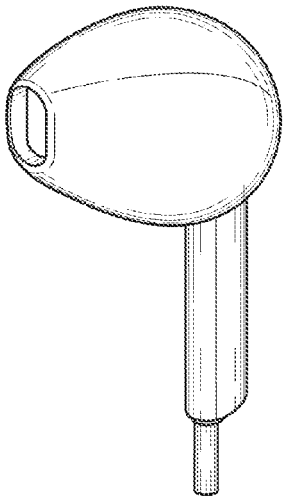
Figure 5H:
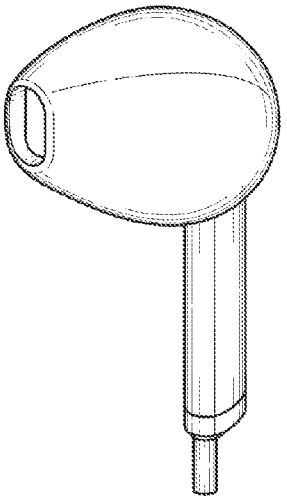

Any suitable polishing techniques may be used to polish the injection molded material. For example, a vapor polish, a flame polish, or a mechanical polish may be applied to buff the cosmetic material, as shown in FIG. 5G. In a vapor polish, a boiling solvent etches away a portion of the material applied to the earbud. FIG. 5H shows earbud 580 with strain relief member 590 molded around a portion of conductor bundle 550.

It should be understood that steps in FIG. 4 are merely illustrative. Any of the steps may be removed, modified, or combined, and any additional steps may be added, without departing from the scope of the invention. For example, a step may be added for coupling a filter assembly to the first sub-enclosure. The filter assembly can be added before or after application of the injected material. As another example, polishing step 460 can be replaced with a painting step, which applies a uniform coat of paint to the cosmetic material.

The described embodiments of the invention are presented for the purpose of illustration and not of limitation.

What is claimed is:

1. An earbud comprising:

a port member defining at least a portion of a volume of a housing; and a driver assembly positioned within the volume of the housing, wherein:

the port member comprises a port;

the driver assembly is operative to direct sound through the port;

a first periphery of the port member in a largest cross-section of the port member surrounds a portion of the driver assembly;

a second periphery of the port member in a smallest cross-section of the port member comprises the port;

a first line extends through a center of the largest cross-section of the port member;

the first line is perpendicular to the largest cross-section of the port member;

a second line extends through the center of the smallest cross-section of the port member;

the second line is perpendicular to the smallest cross-section of the port member; and the first line is parallel to but offset from the second line.

2. The earbud of claim 1, wherein the largest cross-section of the port member is parallel to the smallest cross-section of the port member.

3. The earbud of claim 1, wherein:

the port is provided through the port member in a first direction; and the first line comprises the first direction.

4. The earbud of claim 3, wherein the first line is perpendicular to the smallest cross-section of the port member.

5. The earbud of claim 1, wherein:

the port is operative to direct the sound out from the housing in a first direction; and the first line comprises the first direction.

6. The earbud of claim 5, wherein the first line is perpendicular to the smallest cross-section of the port member.

7. The earbud of claim 1, wherein:

the housing provides the port member and a neck member extending away from the port member in a first direction;

the port is provided through the port member in a second direction; and a third line comprising the first direction does not intersect the second line comprising the second direction.

8. The earbud of claim 7, wherein the first line and the third line are skew.

9. The earbud of claim 1, wherein:

the housing provides the port member and a neck member extending away from the port member in a first direction;

the first line and a third line comprising the first direction are skew.

10. The earbud of claim 1, wherein:

the housing provides the port member and a neck member extending away from the port member in a first direction;

the second line and a third line comprising the first direction are skew.

11. The earbud of claim 1, wherein:

the housing provides the port member and a neck member extending away from the port member in a first direction;

the port is operative to direct sound out from the port member in a second direction;

the first direction and the second direction are skew.

12. The earbud of claim 1, wherein:

the housing provides the port member and a neck member extending away from the port member in a first direction;

the housing comprises a first sub-enclosure coupled to a second sub-enclosure for providing the port member and the neck member;

the earbud further comprises a component covering at least a portion of the housing; and the at least a portion of the housing comprises at least a portion of a junction between the coupled first and second sub-enclosures of the housing.

13. The earbud of claim 12, wherein:

the port is operative to direct sound out from the port member in a second direction;

the first direction and the second direction are skew.

14. The earbud of claim 13, wherein the first line and a third line comprising the first direction are skew.

15. The earbud of claim 12, wherein the first line and a third line comprising the first direction are skew.

16. The earbud of claim 12, wherein the at least a portion of the housing comprises the junction between the coupled first and second sub-enclosures of the housing.

17. The earbud of claim 12, wherein the at least a portion of the housing further comprises at least a portion of the port member.

18. The earbud of claim 12, wherein the at least a portion of the housing further comprises at least a portion of the neck member.

19. The earbud of claim 12, wherein a first line extending along the first direction does not intersect a second line extending along the second direction.

20. The earbud of claim 1, wherein the port member is a non-occluding member.

* * * * *